US008465167B2

(12) United States Patent
Maxik et al.

(10) Patent No.: US 8,465,167 B2
(45) Date of Patent: Jun. 18, 2013

(54) COLOR CONVERSION OCCLUSION AND ASSOCIATED METHODS

(75) Inventors: Fredric S. Maxik, Indialantic, FL (US); Eric Bretschneider, Satellite Beach, FL (US); Robert R. Soler, Cocoa Beach, FL (US); David E. Bartine, Cocoa, FL (US)

(73) Assignee: Lighting Science Group Corporation, Satellite Beach, FL (US)

( * ) Notice: Subject to any disclaimer, the term of this patent is extended or adjusted under 35 U.S.C. 154(b) by 0 days.

(21) Appl. No.: 13/234,371

(22) Filed: Sep. 16, 2011

(65) Prior Publication Data

US 2013/0070439 A1 Mar. 21, 2013

(51) Int. Cl.
*F21V 9/16* (2006.01)

(52) U.S. Cl.
USPC ..... 362/84; 362/606

(58) Field of Classification Search
USPC ..... 362/84, 606–609, 612
See application file for complete search history.

(56) References Cited

U.S. PATENT DOCUMENTS

| | | | |
|---|---|---|---|
| 5,057,908 | A | 10/1991 | Weber |
| 5,523,878 | A | 6/1996 | Wallace et al. |
| 5,704,701 | A | 1/1998 | Kavanagh et al. |
| 5,813,753 | A | 9/1998 | Vriens et al. |
| 5,997,150 | A | 12/1999 | Anderson |
| 6,140,646 | A | 10/2000 | Busta et al. |
| 6,341,876 | B1 | 1/2002 | Moss et al. |
| 6,356,700 | B1 | 3/2002 | Strobl |
| 6,561,656 | B1 | 5/2003 | Kojima et al. |
| 6,594,090 | B2 | 7/2003 | Kruschwitz et al. |
| 6,733,135 | B2 | 5/2004 | Dho |
| 6,767,111 | B1 | 7/2004 | Lai |
| 6,817,735 | B2 | 11/2004 | Shimizu et al. |
| 6,870,523 | B1 | 3/2005 | Ben-David et al. |
| 6,871,982 | B2 | 3/2005 | Holman et al. |
| 6,967,761 | B2 | 11/2005 | Starkweather et al. |
| 6,974,713 | B2 | 12/2005 | Patel et al. |
| 7,042,623 | B1 | 5/2006 | Huibers et al. |
| 7,070,281 | B2 | 7/2006 | Kato |
| 7,072,096 | B2 | 7/2006 | Holman et al. |
| 7,075,707 | B1 | 7/2006 | Rapaport et al. |
| 7,083,304 | B2 | 8/2006 | Rhoads et al. |
| 7,178,941 | B2 | 2/2007 | Roberge et al. |

(Continued)

FOREIGN PATENT DOCUMENTS

| | | |
|---|---|---|
| EP | 0851260 | 7/1998 |
| WO | WO2012/135173 | 10/2012 |

OTHER PUBLICATIONS

N. T. Obot, W. J. Douglas, A. S. Mujumdar, "Effect of Semi-confinement on Impingement Heat Transfer", Proc. 7th Int. Heat Transf. Conf., 1982, pp. 1355-1364, vol. 3.

(Continued)

*Primary Examiner* — Anne Hines
(74) *Attorney, Agent, or Firm* — Mark R. Malek; Daniel D. Pierron; Zies Widerman & Malek

(57) ABSTRACT

A light converting device is described for receiving source light within a source wavelength range, converting the source light into a converted light, and reflecting the converted light to a desired output direction. The lighting device may use a color conversion occlusion to receive the source light and reflect a converted light in the desired output direction. The converted light may be intermediately reflected by the enclosure as it is directed in the desired output direction.

39 Claims, 7 Drawing Sheets

U.S. PATENT DOCUMENTS 7,184,201 B2 2/2007 Duncan
7,187,484 B2 3/2007 Mehrl
7,213,926 B2 5/2007 May et al.
7,246,923 B2 7/2007 Conner
7,247,874 B2 7/2007 Bode et al.
7,255,469 B2 8/2007 Wheatley et al.
7,261,453 B2 8/2007 Morejon et al.
7,289,090 B2 10/2007 Morgan
7,300,177 B2 11/2007 Conner
7,303,291 B2 12/2007 Ikeda et al.
7,325,956 B2 2/2008 Morejon et al.
7,342,658 B2 3/2008 Kowarz et al.
7,344,279 B2 3/2008 Mueller et al.
7,349,095 B2 3/2008 Kurosaki
7,353,859 B2 4/2008 Stevanovic et al.
7,382,091 B2 6/2008 Chen
7,382,632 B2 6/2008 Alo et al.
7,400,439 B2 7/2008 Holman
7,427,146 B2 9/2008 Conner
7,429,983 B2 9/2008 Islam
7,434,946 B2 10/2008 Huibers
7,438,443 B2 10/2008 Tatsuno et al.
7,476,016 B2 1/2009 Kurihara
7,520,642 B2 4/2009 Holman et al.
7,530,708 B2 5/2009 Park
7,537,347 B2 5/2009 Dewald
7,540,616 B2 6/2009 Conner
7,556,406 B2 7/2009 Petroski et al.
7,598,686 B2 10/2009 Lys et al.
7,605,971 B2 10/2009 Ishii et al.
7,626,755 B2 12/2009 Furuya et al.
7,677,736 B2 3/2010 Kasazumi et al.
7,684,007 B2 3/2010 Hull et al.
7,703,943 B2 4/2010 Li et al.
7,705,810 B2 4/2010 Choi et al.
7,709,811 B2 5/2010 Conner
7,719,766 B2 5/2010 Grasser et al.
7,728,846 B2 6/2010 Higgins et al.
7,732,825 B2 6/2010 Kim et al.
7,766,490 B2 8/2010 Harbers et al.
7,819,556 B2 10/2010 Heffington et al.
7,828,453 B2 11/2010 Tran et al.
7,828,465 B2 11/2010 Roberge et al.
7,832,878 B2 11/2010 Brukilacchio et al.
7,834,867 B2 11/2010 Sprague et al.
7,835,056 B2 11/2010 Doucet et al.
7,841,714 B2 11/2010 Gruber
7,845,823 B2 12/2010 Mueller et al.
7,871,839 B2 1/2011 Lee
7,880,400 B2 2/2011 Zhou et al.
7,889,430 B2 2/2011 El-Ghoroury et al.
7,906,789 B2 3/2011 Jung et al.
7,928,565 B2 4/2011 Brunschwiler et al.
7,972,030 B2 7/2011 Li
7,976,205 B2 7/2011 Grotsch et al.
8,016,443 B2 9/2011 Falicoff et al.
8,040,070 B2 10/2011 Myers et al.
8,047,660 B2 11/2011 Penn et al.
8,049,763 B2 11/2011 Kwak et al.
8,061,857 B2 11/2011 Liu et al.
8,070,302 B2 12/2011 Hatanaka et al.
8,076,680 B2 12/2011 Lee et al.
8,083,364 B2 12/2011 Allen
8,096,668 B2 1/2012 Abu-Ageel
8,115,419 B2 2/2012 Given et al.
8,188,687 B2 5/2012 Lee et al.
2003/0039036 A1 2/2003 Kruschwitz et al.
2004/0052076 A1 3/2004 Mueller et al.
2004/0218390 A1 11/2004 Holman et al.
2005/0174768 A1 8/2005 Conner
2005/0190430 A1 9/2005 Patel et al.
2005/0218780 A1* 10/2005 Chen ..... 313/467
2006/0002101 A1 1/2006 Wheatley et al.
2006/0002108 A1 1/2006 Ouderkirk et al.
2006/0002110 A1 1/2006 Dowling et al.
2006/0164005 A1 7/2006 Sun
2006/0164607 A1 7/2006 Morejon et al.
2006/0232992 A1 10/2006 Bertram et al.
2006/0285078 A1 12/2006 Kasazumi et al.
2006/0285193 A1 12/2006 Kimura et al.
2006/0291269 A1 12/2006 Doucet et al.
2007/0013871 A1 1/2007 Marshall et al.
2007/0146639 A1 6/2007 Conner
2007/0159492 A1 7/2007 Lo et al.
2007/0188847 A1 8/2007 McDonald et al.
2007/0211449 A1 9/2007 Holman et al.
2007/0241340 A1 10/2007 Pan
2007/0263298 A1 11/2007 El-Ghoroury et al.
2007/0273794 A1 11/2007 Sprague et al.
2008/0062644 A1 3/2008 Petroski
2008/0143970 A1 6/2008 Harbers et al.
2008/0143973 A1 6/2008 Wu
2008/0198572 A1 8/2008 Medendorp
2008/0218992 A1 9/2008 Li
2008/0232084 A1 9/2008 Kon
2008/0258643 A1 10/2008 Cheng et al.
2008/0285271 A1 11/2008 Roberge et al.
2008/0316432 A1 12/2008 Tejada et al.
2009/0009102 A1 1/2009 Kahlman et al.
2009/0046307 A1 2/2009 Kwak et al.
2009/0059099 A1 3/2009 Linkov et al.
2009/0059585 A1 3/2009 Chen et al.
2009/0128781 A1 5/2009 Li
2009/0129079 A1 5/2009 Grotsch et al.
2009/0160370 A1 6/2009 Tai et al.
2009/0232683 A1 9/2009 Hirata et al.
2009/0261748 A1 10/2009 Mckinney et al.
2009/0262516 A1 10/2009 Li
2009/0273918 A1 11/2009 Falicoff et al.
2009/0273931 A1* 11/2009 Ito et al. ..... 362/267
2010/0006762 A1 1/2010 Yoshida et al.
2010/0046234 A1 2/2010 Abu-Ageel
2010/0051976 A1 3/2010 Rooymans
2010/0053959 A1* 3/2010 Ijzerman et al. ..... 362/235
2010/0060181 A1 3/2010 Choi et al.
2010/0061068 A1 3/2010 Geissler et al.
2010/0061078 A1 3/2010 Kim
2010/0072494 A1 3/2010 Lee
2010/0103389 A1 4/2010 McVea et al.
2010/0110516 A1 5/2010 Penn et al.
2010/0128233 A1 5/2010 Liu et al.
2010/0165599 A1 7/2010 Allen
2010/0202129 A1 8/2010 Abu-Ageel
2010/0213859 A1 8/2010 Shteynberg et al.
2010/0231136 A1 9/2010 Reisenauer et al.
2010/0231863 A1 9/2010 Hikmet et al.
2010/0232134 A1 9/2010 Tran
2010/0244700 A1 9/2010 Chong et al.
2010/0244724 A1 9/2010 Jacobs et al.
2010/0270942 A1 10/2010 Hui et al.
2010/0277084 A1 11/2010 Lee et al.
2010/0302464 A1 12/2010 Raring et al.
2010/0308738 A1 12/2010 Shteynberg et al.
2010/0308739 A1 12/2010 Shteynberg et al.
2010/0315320 A1 12/2010 Yoshida
2010/0320927 A1 12/2010 Gray et al.
2010/0320928 A1 12/2010 Kaihotsu et al.
2010/0321641 A1 12/2010 Van Der Lubbe
2010/0321933 A1 12/2010 Hatanaka et al.
2011/0012137 A1 1/2011 Lin et al.
2011/0080635 A1 4/2011 Takeuchi
2012/0250137 A1 10/2012 Maxik et al.

OTHER PUBLICATIONS

Arthur P. Fraas, Heat Exchanger Design, 1989, p. 60, John Wiley & Sons. Inc., Canada.

J. Y. San, C. H. Huang, M. H. Shu, "Impongement cooling of a confined circular air jet", Int. J. Heat Mass Transf., 1997, pp. 1355-1364, vol. 40.

H. A. El-Shaikh, S. V. Garimella, "Enhancement of Air Het Impingement Heat Transfer using Pin-Fin Heat Sinks", IEEE Transactions on Components and Packaging Technology, Jun. 2000, vol. 23, No. 2.

Yongmann M. Chung, Kai H. Luo, "Unsteady Heat Transfer Analysis of an Impinging Jet", Journal of Heat Transfer—Transactions of the ASME, Dec. 2002. pp. 1039-1048, vol. 124, No. 6.

S. A. Solovitz, L. D. Stevanovic, R. A. Beaupre, "Microchannels Take Heatsinks to the Next Level", Power Electronics Technology, Nov. 2006.
Tannith Cattermole. "Smart Energy Glass controls light on demand", Gizmag.com, Apr. 18, 2010, accessed Nov. 1, 2011.
U.S. Appl. No. 13/357,283, filed Jan. 24, 2012, Maxik et al.
U.S. Appl. No. 13/465,781, filed May 7, 2012, Maxik et al.
U.S. Appl. No. 13/633,914, filed Oct. 3, 2012, Maxik et al.
Arthur P. Fraas, Heat Exchanger Design, 1989, p. 60, John Wiley & Sons, Inc., Canada.
H. A El-Shaikh, S. V. Garimella, "Enhancement of Air Jet Impingement Heat Transfer using Pin-Fin Heat Sinks", D IEEE Transactions on Components and Packaging Technology, Jun. 2000, vol. 23, No. 2.
Jones, Eric D., Light Emitting Diodes (LEDs) for General Lumination, an Optoelectronics Industry Development Association (OIDA) Technology Roadmap, OIDA Report, Mar. 2001, published by OIDA in Washington D.C.
J. Y. San, C. H. Huang, M. H, Shu, "Impingement cooling of a confined circular air jet", In t. J. Heat Mass Transf., 1997. pp. 1355-1364, vol. 40.
N. T. Obot, W. J. Douglas, A S. Mujumdar, "Effect of Semi-confinement on Impingement Heat Transfer", Proc. 7th Int. Heat Transf. Conf., 1982, pp. 1355-1364. vol. 3.
S. A Solovitz, L. D. Stevanovic, R. A Beaupre, "Microchannels Take Heatsinks to the Next Level", Power Electronics Technology, Nov. 2006.
Tannith Cattermole, "Smart Energy Class controls light on demand", Gizmag.com, Apr. 18, 2010 accessed Nov. 1, 2011.
Yongmann M. Chung, Kai H. Luo, "Unsteady Heat Transfer Analysis of an Impinging Jet", Journal of Heat Transfer—Transactions of the ASME, Dec. 2002, pp. 1039-1048, vol. 124, No. 6.

* cited by examiner

COLOR CONVERSION OCCLUSION AND ASSOCIATED METHODS

FIELD OF THE INVENTION

The present invention relates to the field of lighting devices and, more specifically, to enclosures for lighting devices having a conversion material located adjacent to an occlusion to convert and reflect light in a desired output direction, and associated methods.

BACKGROUND OF THE INVENTION

Lighting devices that include a conversion material may conveniently allow the conversion of light from a source light into light of a different wavelength range. Often, such conversion may be performed by using a luminescent, fluorescent, or phosphorescent material. These wavelength conversion materials may sometimes be included in the bulk of another material, applied to a lens or optic, or otherwise be located in line with the light emitted from a light source. In some instances the conversion material may be applied to the light source itself. A number of disclosed inventions exist that describe lighting devices that utilize a conversion material applied to an LED to convert light with a source wavelength range into light with a converted wavelength range.

However, LEDs and other lighting elements may generate heat during operation. Applying a conversion material directly upon a lighting element may cause the coating to be exposed to an excessive amount of heat resulting in decreased operational efficiency of the conversion material.

In the past, proposed solutions have attempted to isolate the color conversion material from the heat generated by the lighting element by locating the conversion coating on an enclosure. After light is emitted from the lighting element, it may then pass through the conversion coated enclosure prior to illuminating a volume. However, coating the entire surface of the enclosure may require copious amounts of conversion coating materials, increasing the production cost of a lighting device employing this method.

Alternatively, previously proposed solutions have disclosed applying a conversion material to a lens, through which the light emitted from a light source may pass. Less conversion material may be required to coat the surface area of the lens, as opposed to the interior of an enclosure. However, the lens may need to be large enough to allow light to pass with sufficiently wide projection angle, thereby requiring a large surface area. Although applying a conversion coating to a lens may be an improvement to applying the coating to an entire enclosure, the lens-based proposed solution is still not optimal.

There exists a need for an enclosure for lighting devices that provides an ability to receive a light emitted from a light source in one wavelength range, convert the source light into a converted light having a converted wavelength range, and reflect the converted light in a desired output direction. There further exists a need for a light converting enclosure that performs the wavelength conversion operation away from a heat generating light source with a minimal color conversion area.

SUMMARY OF THE INVENTION

With the foregoing in mind, embodiments of the present invention relate to a light converting device that may advantageously receive a source light emitted from a light source in a source wavelength range, convert the source light to a converted light within a converted wavelength range, and reflect the converted light in a desired output direction. The light converting device, according to an embodiment of the present invention, may perform the wavelength conversion operation away from the light source, advantageously increasing the efficiency of the conversion operation by decreasing the amount of heat to which the conversion coating may be exposed. The source light may also be converted to a converted light in a concentrated area, reducing the amount of conversion material required to achieve the desired conversion effect. By providing a light converting device that may advantageously convert and reflect light in one operation, away from the heat generating light source, embodiments of the present invention may benefit from reduced complexity, size, and manufacturing expense.

These and other objects, features, and advantages, according to various embodiments of the presenting invention, are provided by a light converting device that may include an enclosure and an occlusion. A conversion material may be located adjacent to the occlusion. The occlusion may be at least partially located within the enclosure to receive a source light within a source wavelength range which may be emitted from a light source. The occlusion may be defined by an arcuate shape.

The conversion material may convert the source light within a source wavelength range to a converted light within a converted wavelength range. The converted light may then be reflected by the occlusion in a desired output direction. Alternately, source light may be received by the occlusion and reflected as a converted light from the occlusion to the enclosure. From the enclosure, the converted light may be reflected to the desired output direction.

The light converting device, according to an embodiment of the present invention, may additionally include one or more occlusion support, which may be connected to the enclosure and the occlusion. The occlusion support may have a first end and a second end, which may be located opposite to the first end. The first end of the occlusion support may be connected to an interior surface of the enclosure. The second end of the occlusion support may be connected to the occlusion. Alternately, the occlusion and occlusion support may be combined as one monolithic device.

The light converting device, according to an embodiment of the present invention, may include a conversion material comprised of luminescent, fluorescent, and/or phosphorescent materials, such as phosphors or quantum dots. The source light may be a monochromatic light. The source light may also be within a source wavelength range of a blue or ultraviolet spectrum. A source wavelength range within the ultraviolet spectrum may be between 200 nanometers and 400 nanometers. Additionally, a source wavelength range within the blue spectrum may be between 400 nanometers and 500 nanometers. The light source may be a light emitting diode (LED).

A method aspect, according to an embodiment of the present invention, for converting a source light to a converted light, using a light converting device having a conversion material located adjacent to an occlusion. The method may include receiving the source light within a source wavelength range at the occlusion. The method may additionally include converting the source light into a converted light, and reflecting the converted light from the occlusion toward a desired output direction. The converted light may intermediately be reflected by the occlusion to an enclosure, from which the converted light may be reflected in the desired output direction.

DETAILED DESCRIPTION OF THE PREFERRED EMBODIMENT

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure. Like numbers refer to like elements throughout.

In this detailed description of various embodiments of the present invention, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the present invention.

Referring now to FIGS. 1-6, a light converting device 10, according to an embodiment of the present invention, is now described in greater detail. Throughout this disclosure, the light converting device 10 may also be referred to as a system or the invention. Alternate references of the light converting device 10 in this disclosure are not meant to be limiting in any way.

Figure 1:
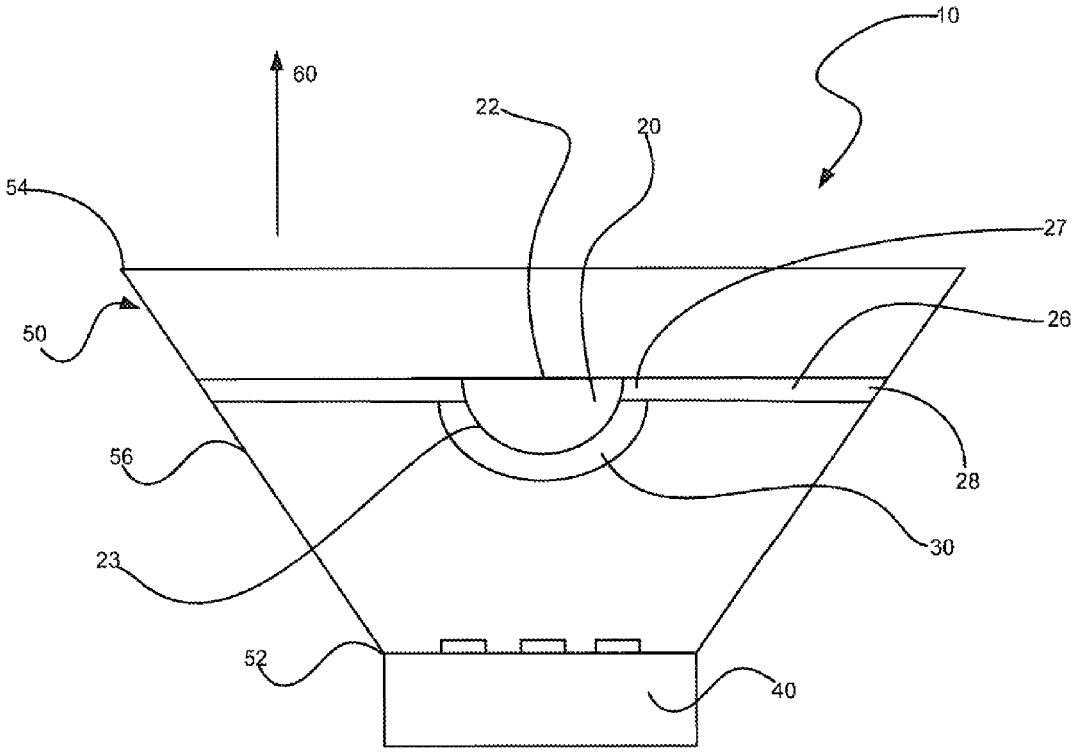
FIG. 1 is a side elevation view illustrating internal elements of a light converting device according to an embodiment of the present invention.
Figure 3:
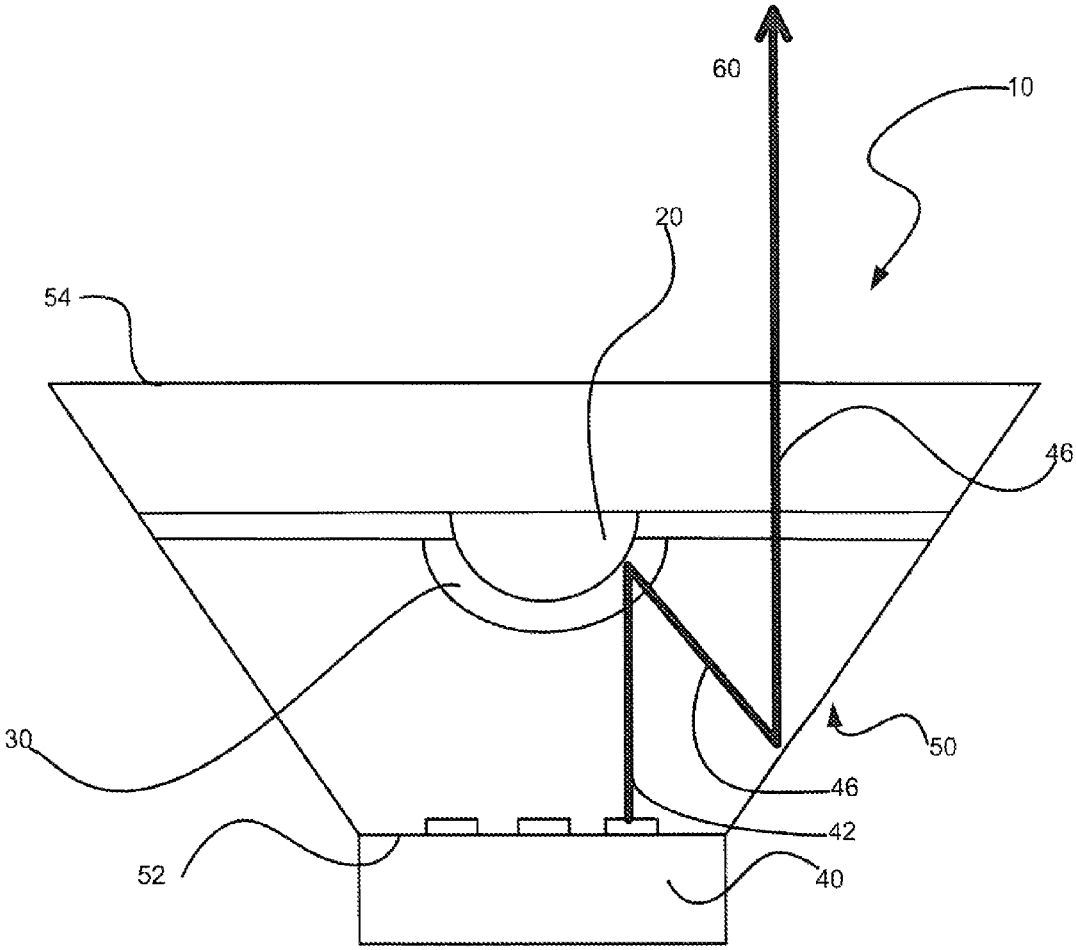
FIG. 3 is a side elevation view illustrating internal elements of a light converting device according to an embodiment of the present invention and illustrating a path of light as it is converted from a source light to a converted light including a light source at a bottom portion of an enclosure.

As perhaps best illustrated in FIG. 1, the light converting device 10 according to an embodiment of the present invention may includes an occlusion 20 to convert a source light 42 into a converted light 46 (FIG. 3). The converted light 46 may be reflected by the occlusion 20 to an enclosure 50, which may, in turn, reflect the converted light 46 in a desired output direction 60. A conversion material 30 may be located adjacent to the occlusion 20 to convert the source light 42 into the converted light 46, as will be described in greater detail below, and as perhaps best illustrated in FIG. 3.

As illustrated, for example, in FIG. 3, the occlusion 20 may receive the source light 42. The source light 42 may originate from a light source 40. The light source 40 may include light emitting diodes (LEDs) capable of emitting light in a source wavelength range. Other embodiments of the present invention may include source light 42 that is generated by a laser based light source 40. Those skilled in the art will appreciate that the source light 42 may be provided by any number of lighting devices, which may include, but should not be limited to, additional light emitting semiconductors.

The source wavelength range of the source light 42 may be emitted in blue or ultraviolet wavelength ranges. However, a person of skill in the art, after having the benefit of this disclosure, will appreciate that LEDs capable of emitting light in any number of wavelength ranges may be used in the light source 40, in accordance with this disclosure of embodiments of the present invention. A skilled artisan will also appreciate, after having the benefit of this disclosure, additional light generating devices that may be used in the light source 40 that are capable of creating an illumination.

As previously discussed, embodiments of the present invention may include a light source 40 that generates source light 42 with a source wavelength range in the blue spectrum. The blue spectrum may include light with a wavelength range between 400 and 500 nanometers. A source light 42 in the blue spectrum may be generated by a light emitting semiconductor that is comprised of materials that may emit a light in the blue spectrum. Examples of such light emitting semiconductor materials may include, but are not intended to be limited to, zinc selenide (ZnSe) or indium gallium nitride (InGaN). These semiconductor materials may be grown or formed on substrates, which may be comprised of materials such as sapphire, silicon carbide (SiC), or silicon (Si). Additionally, an embodiment of the light source 40 may include a light emitting semiconductor that is removed from the substrate. In this embodiment, the light emitting semiconductor may optionally be bonded to another surface or material. A person of skill in the art will appreciate that, although the preceding semiconductor materials have been disclosed herein, any semiconductor device capable of emitting a light in the blue spectrum is intended to be included within the scope of the embodiments of the present invention.

Additionally, as previously discussed, embodiments of the present invention may include a light source 40 that generates source light 42 with a source wavelength range in the ultraviolet spectrum. The ultraviolet spectrum may include light with a wavelength range between 200 and 400 nanometers. A source light 42 in the ultraviolet spectrum may be generated by a light emitting semiconductor that is comprised of materials that may emit a light in the ultraviolet spectrum. Examples of such light emitting semiconductor materials may include, but are not intended to be limited to, diamond (C), boron nitride (BN), aluminum nitride (AlN), aluminum gallium nitride (AlGaN), or aluminum gallium indium nitride (AlGaInN). These semiconductor materials may be grown or formed on substrates, which may be comprised of materials such as sapphire, silicon carbide (SiC), or Silicon (Si). Additionally, an embodiment of the light source 40 may include a light emitting semiconductor that is removed from the substrate. In this embodiment, the light emitting semiconductor may optionally be bonded to another surface or material. A person of skill in the art will appreciate that, although the preceding semiconductor materials have been disclosed herein, any semiconductor device capable of emitting a light in the ultraviolet spectrum is intended to be included within the scope of the embodiments of the present invention.

A person of skill in the art will appreciate that the substrate and semiconductor materials discussed in the preceding illustrative embodiments have been included only as examples, in the interest of clarity, and without any intent to be limiting. Skilled artisans will likewise appreciate a plethora of additional semiconductors, substrate materials, and combinations thereof, which may be used to create a light emitting semiconductor that may emit a source light 42. As such, those of skill in the art will appreciate that the additional substrate and semiconductor materials, and configurations including those materials, are intended to be included within the scope and spirit of the present invention.

The light source 40, according to an embodiment of the present invention, may include an organic light emitting diode (OLED). An OLED may be a comprised of an organic compound that may emit light when an electric current is applied. The organic compound may be positioned between two electrodes. Typically, at least one of the electrodes may be transparent.

In an additional embodiment of the light converting device 10 of the present invention, the light source 40 may include an electroluminescent material. An electroluminescent material may be included within the definition of a light emitting semiconductor. A light source 40 including electroluminescent materials may be comprised of organic and/or inorganic materials. Skilled artisans will appreciate that light may be emitted as a result of an electric voltage, generated from a direct current (DC) or alternating current (AC) source, being applied across the electroluminescent material. In an embodiment of the light source 40 including an electroluminescent material, the electric voltage may cause the electrons to enter an excited state through impact ionization. Light may then be emitted as the energy of the electrons decay back to the ground state. Additional embodiments of the light source 40 that include an electroluminescent material will be apparent to a person of skill in the art, and are intended to be included within the scope of light converting device 10 disclosed herein.

The source light 42 may be converted by the conversion material 30 into a converted light 46 with an organic wavelength range, or wavelength range that triggers psychological cues within the human brain. This wavelength range may include a selective portion of the source light 42. These organic wavelength ranges may include one or more wavelength ranges that trigger positive psychological responses. As a result of a positive psychological response, the brain may affect the production of neurological chemicals, such as, for example, by inducing or suppressing the production of melatonin. The positive psychological responses may be similar to those realized in response to natural light or sunlight.

A person of skill in the art will appreciate that the light converting device 10 may receive a source light 42 that is monochromatic, bichromatic, or polychromatic. A monochromatic light is a light that may include one wavelength range. A bichromatic light is a light that includes two wavelength ranges that may be derived from one or two light sources 40. A polychromatic light is a light that may include a plurality of wavelength ranges, which may be derived from one or more light sources 40. Preferably, the light converting device 10, according to an embodiment of the present invention, may include a monochromatic light. However, a person of skill in the art will appreciate bichromatic and polychromatic light sources 40 to be included within the scope and spirit of various embodiments of the present invention.

The light converting device 10, according to an embodiment of the present invention, may additionally include an enclosure 50, which may enclose or encompass the other elements of the light converting device 10. The enclosure 50 may be constructed from a plethora of materials, such as, for example, a polycarbonate material. The enclosure 50 may be a structure of any shape or length, which may partially or entirely enclose the other elements of the light converting device 10, according to an embodiment of the present invention. Presented as a non-limiting example, illustrative shapes may include, for example, cylindrical, semi-cylindrical, conical, pyramidal, arcuate, round, rectangular, or any other shape.

Figure 2:
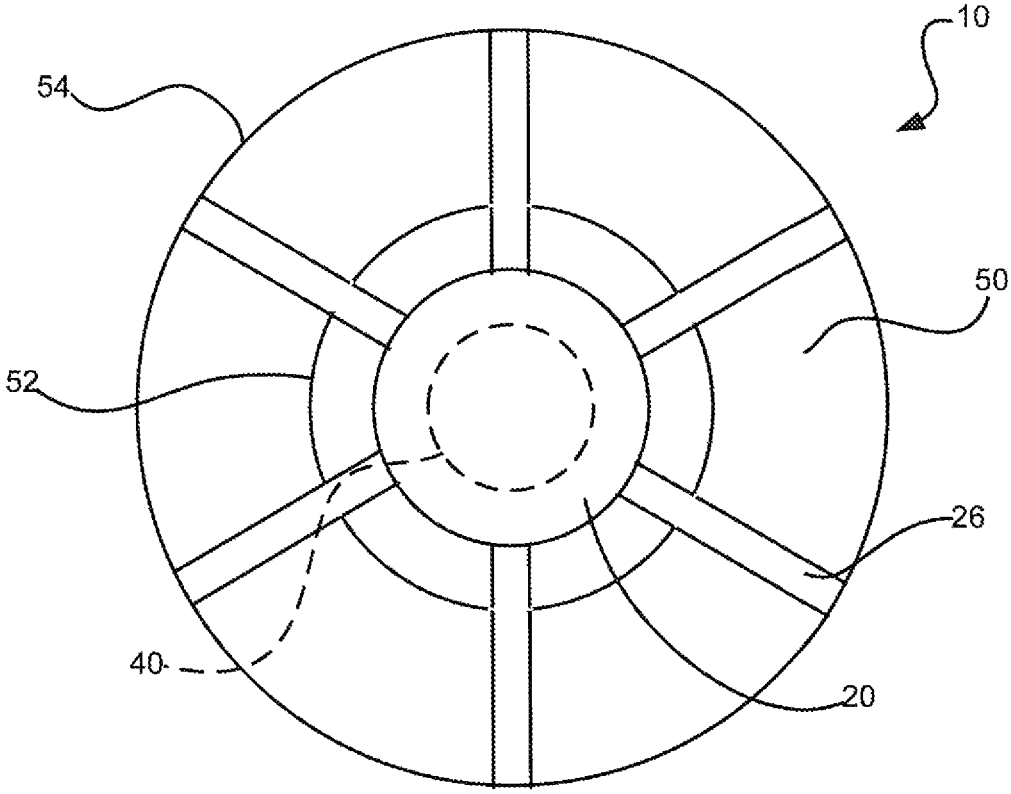
FIG. 2 is a top plan view of the lighting converting device illustrated in FIG. 1.
Figure 3A:
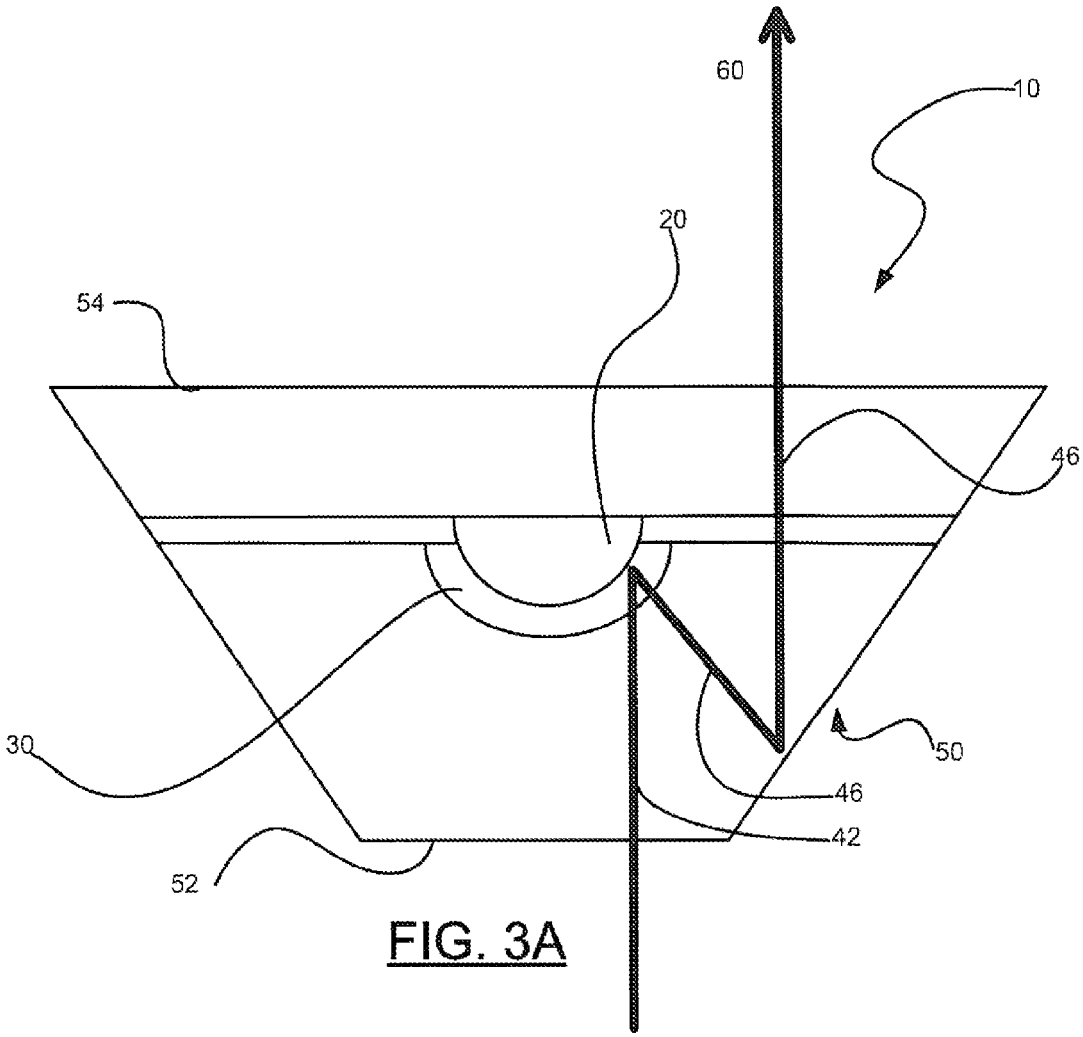
FIG. 3A is a side elevation view illustrating internal elements of a light converting device according to an embodiment of the present invention and illustrating a path of light as it is converted from a source light to a converted light.

Referring now to FIGS. 1-3, structurally, the enclosure 50 may include walls 56 to enclose a volume. The walls 56, and therefore the enclosure 50, may be further defined by a top portion 54 and a bottom portion 52. The top portion 54 and bottom portion 52 of the enclosure 50 may completely enclose the interior elements of the light converting device 10 or partially enclose the interior elements. Additionally, as perhaps best illustrated in FIG. 3A, the top portion 54 and/or bottom portion 52 of the enclosure 50 may remain open to expose the interior elements to the space that may exist beyond the enclosure 50. With the bottom end 52 of the enclosure 50 opened, a source light 42 may be received by the occlusion 20 that may be originated externally.

The additional elements of the light converting device 10, according to an embodiment of the present invention, may be enclosed within the enclosure 50. Such elements may include the light source 40, occlusion 20, occlusion support 26, and/or additional elements that may exist in one or more embodiments of the present invention. Additionally, the aforementioned elements may be enclosed completely or partially within the enclosure 50.

For example, an occlusion 20 may include its bottom end 23 within the volume enclosed by the enclosure 50. The occlusion 20 may also be connected to and supported by occlusion supports 26 at its top end 22, outside of the volume enclosed by the enclosure 50. The occlusion 20 will be discussed in greater detail below. Those skilled in the art will appreciate that the occlusion 20 and the occlusion supports 26 may be integrally formed as a monolithic unit, or may be separated into different pieces that are connected with one another by any number of connections.

The walls 56 of the enclosure 50 may be defined by an inner surface and an outer surface. The inner surface of the enclosure 50 may face the volume enclosed by the enclosure 50. Conversely, the outer surface of the enclosure 50 may face the opposite direction of the inner surface, facing the atmospheric volume excluded by the enclosure 50.

The inner surface of the enclosure 50 may be comprised of a reflective material to reflect the light that may be directed from the light source 40 to the inner surface of the enclosure 50, or reflected from the occlusion 20 to the inner surface of the enclosure 50. In an alternate configuration, the inner surface of the enclosure 50 may be coated with, or otherwise include, a light reflective material, providing the desired light reflective qualities. Those skilled in the art will appreciate that any amount of the inner surface of the enclosure 50 may include the reflective material, i.e., only a portion of inner surface of the enclosure may include the reflective material. Additionally, the walls 56 of the enclosure 50 may be transparent or translucent, allowing a portion of the light received by the walls 56 to be transmitted through the enclosure 50. A person of skill in the art will appreciate additional configurations of the enclosure 50, after having the benefit of this disclosure, that are included within the scope and spirit of embodiments of the present invention.

Continuing to reference FIGS. 1-2, additional features of the light converting device 10, according to an embodiment of the present invention, will now be discussed in greater detail. More specifically, the occlusion 20 will now be discussed. An occlusion 20 is an object that may be located between the light source 40 and the desired output direction 60. The term, occlusion 20, reflects its nature, since it may obstruct or occlude the direct pathway of the source light 42 emitted by the light source 40 to a desired output direction 60. The occlusion 20 may be positioned to intercept, or receive, the source light 42 emitted from the light source 40.

The occlusion 20 may be constructed from a myriad of materials, such as, for example, a polycarbonate material. The occlusion 20 may additionally be sculpted or configured to reflect the received source light 42 in a reflected direction, such as toward the enclosure 50. Examples of various shaped configurations of the occlusion 20, provided without limitation, may include a dome, arch, bulge, bubble, bend, semicircular, slant, camber, diagonal, incline, pitch, catawampus, or other shaped configuration that may reflect light in a desired direction. For clarity in the following disclosure, the occlusion 20 will be depicted and discussed to be configured with a dome shape. A person of skill in the art will appreciate that the use of a dome is for illustrative purposes only, and is not intended to limit the light converting device 10 in any way.

The following embodiment is presented for illustrative purposed, and is not intended to be limiting. As perhaps best illustrated in FIGS. 1 and 2, the occlusion 20 may be further defined to include a top end 22 and a bottom end 23. The top end 22 of the occlusion 20 may be positioned such that the surface of the top end 22 may approximately face away from the light source 40. Conversely, the bottom end 23 of the occlusion 20 may face the light source 40. As a result, the bottom end 23 of the occlusion 20 may receive and reflect the source light 42 emitted by the light source 40.

The reflective surface of the occlusion 20, located at its bottom end 23, may reflect the light to the enclosure 50, which may subsequently reflect the light in the desired output direction 60. Possible configurations of the occlusion 20 to reflect light to the enclosure 50, from which the light may be reflected in the desired output direction 60, may include, as non-limiting examples, domed, arched, bulged, semicircular, or arcuate configurations. Skilled artisans should not limit the shape of the occlusion 20 to the aforementioned examples. This reflection may perhaps be best illustrated in FIG. 3

Alternately, the reflective surface of the bottom end 23 of the occlusion 20 may reflect the source light 42 emitted from the light source 40 in the desired output direction 60. This alternate configuration may not include reflecting the converted light from the enclosure 50. Possible configurations of the occlusion 20 to reflect light in the above mentioned manner may include, as non-limiting examples, slanted, bent, diagonal, angled, or pitched configurations. This reflection may perhaps be best illustrated in FIG. 4.

The occlusion 20 may be connected to the enclosure 50 via an occlusion support 26. The occlusion support 26 may be defined to include a first end 27 and a second end 28. The first end 27 of the occlusion support 26 may be operatively connected to the occlusion 20, to support and provide stability to the occlusion, included within the enclosure 50. Such operative connections may include, but should not be limited to, adhering, welding, gluing, bonding, screwing, inserting, wedging, or otherwise connecting. Those skilled in the art will also appreciate that embodiments of the present invention contemplate that the occlusion support 26 and the occlusion 20 may be integrally formed as a monolithic unit.

The second end 28 of the occlusion support 26 may be operatively connected to the enclosure 50 to support and provide stability to the occlusion 20 and, additionally, the occlusion support 26. Such operative connections may include, but should not be limited to, adhering, welding, gluing, bonding, screwing, inserting, wedging, or otherwise connecting. Those skilled in the art will also appreciate embodiments of the present invention that contemplate an enclosure 50 having an integrally formed occlusion 20 with occlusion supports 26.

One or more occlusion supports 26 may be included in the light converting device 10, according to an embodiment of the present invention, as may be necessary to provide the desired stability and security of the occlusion 20 located at least partially within the volume enclosed by the enclosure 50. A person of skill in the art will appreciate that the occlusion support 26 may be of any shape, size, or configuration that may allow the occlusion 20 to be supported at least partially within the enclosure 50.

As a non-limiting example, the occlusion support 26 may be an elongated, narrow member, such to provide support to the occlusion 20 while minimally obstructing light. Alternately, as a second non-limiting example, the occlusion support 26 may include one of many fins, which may collectively act as a heatsink to dissipate heat away from the occlusion 20 during operation. A person of skill in the art will appreciate various additional configurations and embodiments of the occlusion support 26 after having the benefit of this disclosure.

The bottom end 23 of the occlusion 20 may include an adjacently located conversion material 30. In an embodiment of the present invention, the conversion material 30 may be a coating applied to the bottom end 23 of the occlusion 20 to alter the source wavelength range of the source light 42 into a converted wavelength range of the converted light 46, which is perhaps best illustrated in FIG. 3.

In an alternate embodiment, the conversion material may be included within the bulk material of the occlusion 20. Including the conversion material 30 within the bulk material of the occlusion 20 is intended to be included in the definition of being located adjacent to the occlusion 20. In this embodiment, the conversion material 30 may be suspended or incorporated in the bulk material that comprises the occlusion 20. The bulk material may include, but should not be limited to, glass or plastic. In a non-limiting example, wherein the conversion material 30 is included in a plastic occlusion 20, the solid occlusion 20 may be formed or molded from plastic in a liquid state. The conversion material 30 may be infused into the liquid plastic prior the solidification of the plastic into a solid occlusion 20. A person of skill in the art will appreciate that, in the present non-limiting example, the conversion material 30 may be infused into liquid plastic homogeneously, methodologically, sporadically, or randomly.

The conversion material 30 is preferably provided by a phosphor or quantum dot material, capable of converting a light with a source wavelength range into a light with one or more converted wavelength ranges. However, it will be appreciated by skilled artisans that any material that may be capable of converting a light from one wavelength range to another wavelength range may be applied to the occlusion 20 and be included within the scope and spirit of the embodiments of the present invention.

A conversion material 30, such as a material based on a fluorescent, luminescent, or phosphorescent material, may alter the wavelength range of light that may be received by and emitted from the material. A source wavelength range may be converted into one or more converted wavelength range. As discussed above, the material may be included in a conversion coating or the bulk material of the occlusion 20. However, it will be appreciated by skilled artisans that any wavelength conversion material capable of converting a light from one wavelength range to another wavelength range may be included as the conversion material 30, and is intended to be included within the scope and spirit of the embodiments of the present invention.

As discussed above, a source light 42 may include a monochromatic, bichromatic, or polychromatic light emitted by one or more light sources 40. For the sake of clarity, references to a source light 42, and its corresponding source wavelength range, should be understood to include the light emitted by the one or more light sources 40 received by the occlusion 20 of the light converting device 10. Correspondingly, a source wavelength range should be understood to be inclusive of the wavelength ranges included in monochromatic, bichromatic, and polychromatic source lights 42.

Additionally, a source light 42 with a source wavelength range may be converted by the conversion material 30 into a converted light 46 with multiple converted wavelength ranges. The use of multiple phosphor and/or quantum dot elements may produce a light that includes multiple discrete or overlapping wavelength ranges. These wavelength ranges may be combined to produce the converted light 46. For further clarity in the foregoing description, references to a converted light 46, and its corresponding converted wavelength ranges, should be understood to include all wavelength ranges that may have been produced as the source light 42 may pass through the conversion material 30.

Luminescence is the emission of light without the requirement of being heated. This is contrary to incandescence, which requires the heating of a material, such as a filament through which a current may be passed, to result in illumination. Luminescence may be provided through multiple processes, including electroluminescence and photoluminescence. Electroluminescence may occur as a current is passed through an electronic substance, such as a light emitting diode or a laser diode. Photoluminescence may occur as light from a first wavelength range may be absorbed by a photoluminescent material to be emitted as light in a second wavelength range. Photoluminescent materials may include fluorescent materials and phosphorescent materials.

A fluorescent material may absorb light within first wavelength range. The energy of the light within the first wavelength range may be emitted as light within a second wavelength range. The absorption and emission operation will be described in greater detail below. A non-limiting example of a fluorescent material may include the material used in a fluorescent light bulb. Fluorescent materials may include, but should not be limited to, phosphors and quantum dots.

The use of phosphorescent material involves absorption and emission of light, similar to use of a fluorescent material, but with differing energy state transitions. These differing energy state transitions may result in a delay between the absorption of light in the first wavelength range and the emission of light in the second wavelength range. A non-limiting example of a device that may utilize a phosphorescent material may include glow-in-the-dark buttons on a remote controller. Phosphorescent materials may include, but should not be limited to, phosphors.

A phosphor substance may provide an illumination when it is energized. Energizing of the phosphor may occur upon exposure to light, such as the source light 42 emitted from the light source 40. The wavelength of light emitted by a phosphor may be dependent on the materials from which the phosphor is comprised. Typically, phosphors may convert a source light 42 into a converted light 46 within a wide converted wavelength range, as will be understood by skilled artisans.

A quantum dot substance may also provide an illumination when it is energized. Energizing of the quantum dot may occur upon exposure to light, such as the source light 42 emitted from the light source 40. Similar to a phosphor, the wavelength of light emitted by a quantum dot may be dependent on the materials from which the quantum dot is comprised. Typically, quantum dots may convert a source light 42 into a converted light 46 within a narrow converted wavelength range, as will be understood by skilled artisans.

The conversion of a source wavelength range into a converted wavelength range may include a shift of wavelength ranges, which may be known to those skilled in the art as a Stokes shift. During a Stokes shift, a portion of the source wavelength range may be absorbed by a conversion material, which may be included in the conversion material. The absorbed portion of the source light 42 may include light within a selective wavelength range, such as, for example, a biologically affective wavelength range. This absorption may result in a decreased intensity of light within the source wavelength range.

The portion of the source wavelength range absorbed by the conversion material may include energy, causing the atoms or molecules of the conversion material to enter an excited state. The excited atoms or molecules may release some of the energy caused by the excited state as light. The light emitted by the conversion material may be defined by a lower energy state than the source light 42 that may have caused the excited state. The lower energy state may result in wavelength ranges of the converted light 46 to be defined by light with longer wavelengths. A person of skill in the art will appreciate additional wavelength conversions that may emit a light with shorter wavelength ranges to be included within the scope of the present invention, as may be defined via the anti-Stokes shift.

As will further be understood by a person of skill in the art, the energy of the light absorbed by the conversion material 30, which may include a conversion material, may shift to an alternate energy of light emitted from the conversion material 30. Correspondingly, the wavelength range of the light absorbed by the conversion material may be scattered to an alternate wavelength range of light emitted from the conversion material. If a light absorbed by the conversion material undergoes significant scattering, the corresponding emitted light may be a low energy light within a wide wavelength range. Substantial scattering characteristics may be definitive of a wide production conversion material, such as, but not limited to, a phosphor. Conversely, if the light absorbed by the conversion material undergoes minimal scattering, the corresponding emitted light may be a low energy light within a narrow wavelength range. Minimal scattering characteristics may be definitive of a narrow production conversion material, such as, but not limited to, a quantum dot.

In an embodiment of the light converting device 10 of the present invention, a plurality of conversion materials 30 may be located adjacent to the bottom end 23 of the occlusion 20 to generate a desired output color. For example, a plurality of phosphors and/or quantum dots may be used that are capable of generating green, blue, and/or red converted light 46. When these conversion materials 30 are located adjacent to the bottom end 23 of the occlusion 20, it may reflect light in the converted wavelength range of the corresponding conversion material 30.

For clarity, the following non-limiting example is provided wherein the occlusion 20 may be coated with, or may otherwise include, a yellow conversion material 30, which may be provided by a yellow zinc silicate phosphor material. The light source 40 may include a blue LED. The yellow zinc silicate conversion material 30 may be evenly distributed on the bottom end 23 of the occlusion 20, which may result in the uniform reflection of blue source light 42 as white converted light 46. The creation of white converted light 46 may be accomplished by combining the converted light 46 with the source light 42. The converted light 46 may be within a converted wavelength range, including a high intensity of light defined within the visible spectrum by long wavelengths, such as yellow light. The source light 42 may be within a source wavelength range, including a high intensity of light defined within the visible spectrum by short wavelengths, such as blue light. By combining the light defined by short and long wavelength ranges within the visible spectrum, such as blue and yellow light, respectively, an approximately white light may be produced.

A person of skill in the art, after having the benefit of this disclosure, will appreciate that conversion materials 30 that produce light in a wavelength range other than white, green, blue, and red may be applied to the occlusion 20 and therefore be included within the scope and spirit of various embodiments of the present invention. A skilled artisan will additionally realize that any number of conversion materials 30, which may be capable of producing converted light 46 of various converted wavelength ranges and corresponding colors, may be located adjacent to the occlusion of the light converting device 10, according to an embodiment of the present invention, and still be included within the scope of this disclosure.

The preceding example, depicting a yellow zinc silicate color conversion material 30 is not intended to be limiting in any way. Instead, the description for the preceding example has been provided for illustrative purposes, solely as a non-limiting example. A skilled artisan will appreciate that any wavelength range, and therefore any corresponding color, may be produced by a conversion material 30 located adjacent to an occlusion 20 and remain within the scope of embodiments of the present invention. Thus, the light converting device 10, according to an embodiment of the present invention, should not in any way be limited by the preceding example.

With continuing reference to FIG. 3, additional features of the light converting device 10 according to an embodiment of the present invention are now described in greater detail. More specifically, the desired output direction 60 of the converted light 46 will now be discussed. After a source light 42 has been converted by the occlusion 20 into a converted light 46, it may be reflected in a desired output direction 60. As discussed above, the reflection of the converted light 46 may additionally be reflected by the enclosure 50 before it may be directed in the desired output direction 60. The light converting device 10, according to an embodiment of the present invention, may reflect the converted light 46 generally in the desired output direction 60, wherein the reflected light may diffuse into a volume, such as a room or stage. The converted light 46 reflected by the light converting device 10 may thus illuminate the volume.

The light converting device 10, according to an embodiment of the present invention, may advantageously convert the wavelength range of a source light 42 and reflect the same in one operation. More specifically, the light converting device 10, according to an embodiment of the present invention, may receive a source light 42, convert the source wavelength range of the source light 42 into a converted wavelength range of a converted light 46, and reflect the converted light 46 in a desired output direction 60.

The source light 42 may be generated by one or more light sources 40. The light source 40 may include at least one light generating element, as previously discussed, which may include LEDs, laser diodes, electroluminescent materials, and/or other light emitting semiconductors. A skilled artisan will appreciate that although the light source 40 is described as including a light emitting semiconductor, any light generating structure may be used and remain within the scope and spirit of embodiments of the present invention.

An LED may emit light when an electrical current is passed through the diode in the forward bias. The LED may be driven by the electrons of the passing electrical current to provide an electroluminescence, or emission of light. The color of the emitted light may be determined by the materials used in the construction of the light emitting semiconductor. The foregoing description contemplates the use of semiconductors that may emit a light in the blue or ultraviolet wavelength range. However, a person of skill in the art will appreciate that light may be emitted by light emitting semiconductors of any wavelength range and remain within the breadth of embodiments of the invention, as disclosed herein. Effectively, a light emitting semiconductor may emit a source light 42 in any wavelength range, since the emitted source light 42 may be subsequently converted by a conversion material 30 located adjacent to the occlusion 30 as it is reflected in the desired output direction 60.

Figure 5:
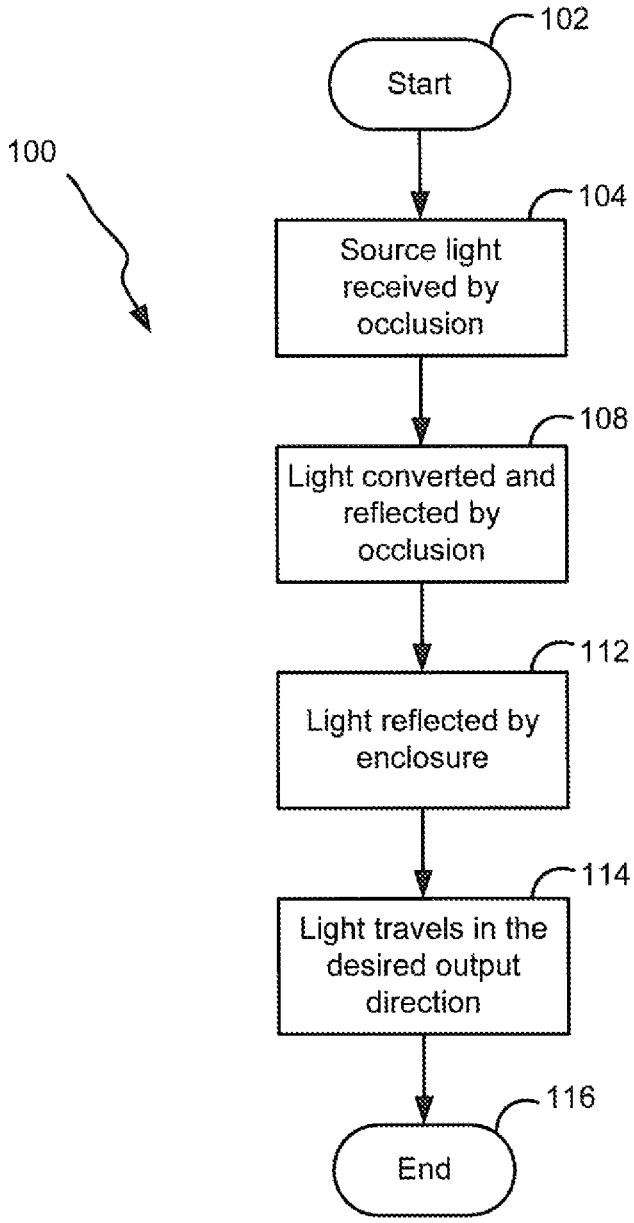
FIG. 5 is a flow chart illustrating a light conversion and reflection operation, as performed using an embodiment of the light converting device according to of the present invention.

Referring now to FIGS. 3 and 5, with an initial focus to FIG. 3, an example of the operation of the light converting device 10, according to an embodiment of the present invention, will now be discussed. A conversion material 30 may be located adjacent to the occlusion 20. The conversion material 30 may be located adjacent to the bottom end 23 of the occlusion, as a non-limiting example. More specifically, without limitation, the conversion material 30 may be located adjacent to a reflective surface on the bottom end 23 of the occlusion to receive the source light 42 emitted by the light source 40.

The conversion material 30 may convert the source light 42 into a converted light 46. With the conversion material 30 located adjacent to the occlusion 20, the source light 42 may be converted into a converted light 46 as it may be reflected by the reflective surface of the occlusion 20.

Focusing now on flowchart 100 of FIG. 5, perhaps best viewed along with FIGS. 1-3, an example of the transmission, conversion, and reflection of light resulting from the operation of the light converting device 10, according to an embodiment of the present invention, will now be discussed in greater detail. Starting at Block 102, a source light 42 may be received and reflected by the occlusion 20 (Block 104). The source light 42 may be emitted, for an example, by a light source 42. As the source light 42 is received and reflected by the occlusion 20, an amount of unconverted source light 42 may pass through the conversion material 30. Accordingly, the source light 42 may be converted into the converted light 46 and reflected by the occlusion 20 via a reflective surface (Block 108). The converted light 46 may then be received and reflected by the enclosure 50 (Block 112). Next, the converted light 46 may travel from the enclosure 50 in the desired output direction 60 (Block 114), ending the conversion operation of the present example at Block 116.

Figure 4:
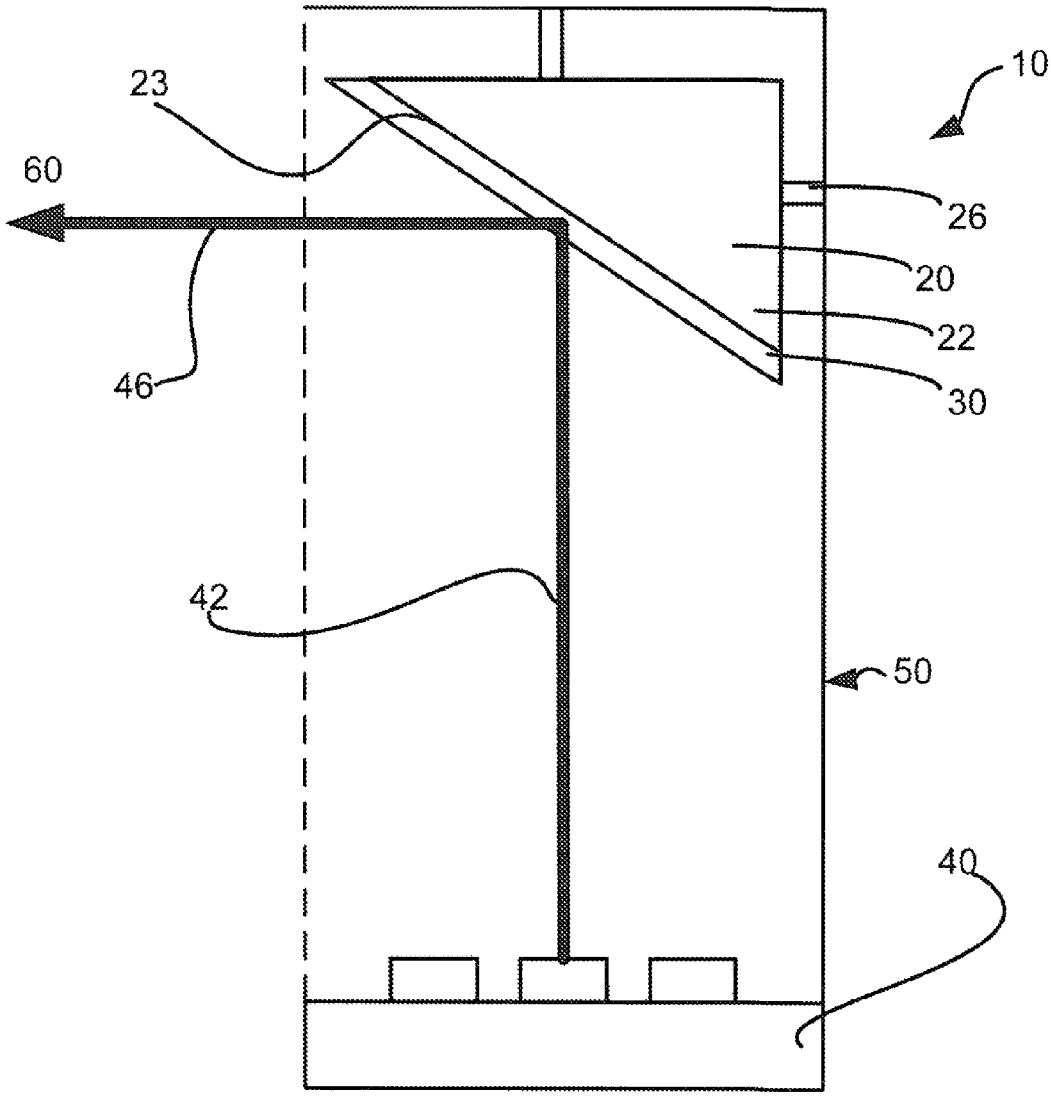
FIG. 4 is a side elevation view illustrating internal elements of a light converting device according to an embodiment of the present invention and illustrating a path of light as it is converted from a source light to a converted light.
Figure 6:
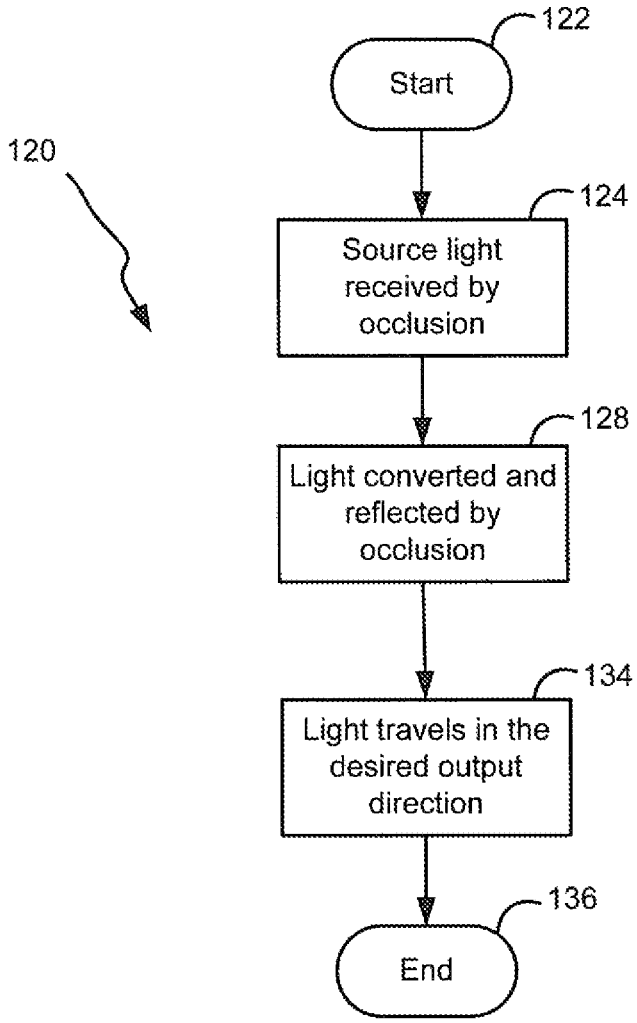
FIG. 6 is a flow chart illustrating a light conversion and reflection operation, as performed using an embodiment of the light converting device according to of the present invention.

Referring now to FIG. 6, perhaps best viewed along with FIG. 4, an additional example of the transmission, conversion, and reflection of light resulting from the operation of the light converting device 10, according to an embodiment of the present invention, will now be discussed in greater detail. Starting at Block 122, a source light 42 may be received and reflected by the occlusion 20 (Block 124). The source light 42 may be emitted, for an example, by a light source 42. As the source light is received and reflected by the occlusion 20, it may pass through the conversion material 30. Accordingly, the source light 42 may be converted into the converted light 46 and reflected by the occlusion 20 via a reflective surface, (Block 128). The converted light 46 may then travel from the occlusion 20 in the desired output direction 60 (Block 134), ending the conversion operation of the present example at Block 136.

In an embodiment of the present invention, during the conversion and reflection operation described in Block 108, the source light 42 may pass though the conversion material 30 located adjacent to the bottom end 23 of the occlusion 20 and undergo a first wavelength conversion into an interim light. The interim light may then be reflected by the occlusion 20 in the desired output direction 60, or alternately to the enclosure 50. As previously discussed, the occlusion 20 may include a reflective surface at its bottom end 23 to reflect light. After being reflected, the interim light may again pass through the conversion material 30.

Accordingly, the light may pass through the conversion material 30 twice, since the conversion material 30 may be located adjacent to the surface of the occlusion 20. By passing the source light 42 through the conversion coating 30 twice, the light converting device 10, according to an embodiment of the present invention, may advantageously require the less conversion material 30 to the convert the source light 42 into a desired amount of converted light 46, with the desired converted wavelength range. As the interim light may pass through the conversion material 30, the interim light may undergo a subsequent wavelength conversion into the converted light 46. The converted light 46 may then continue to travel in the desired output direction 60, which may include being intermediately reflected by the enclosure 50.

Due to the isolation of the conversion material from the heat generating elements, such as the light source 40, and the double conversion operation, as described above, the light converting device 10, according to an embodiment of the present invention, may beneficially reduce the volume and quantity of the conversion material 30 that may be required to perform the conversion operation at the occlusion 20 to achieve a desired converted wavelength range. This reduction of conversion material 30 required to convert the source light 42 into the converted light 46 may advantageously provide increased efficiency and decreased cost of material.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

What is claimed is:

1. A light converting device comprising:

an enclosure;

an occlusion; and a conversion material located adjacent to and generally conforming to a contour of at least part of the occlusion;

wherein at least part of the occlusion is located within the enclosure to receive a source light within a source wavelength range;

wherein the conversion material converts the source light to a converted light within a converted wavelength range;

wherein the converted light is reflected by the occlusion to a desired output direction.

2. A light converting device according to claim 1 wherein the source light is received by the occlusion, reflected from the occlusion to the enclosure and reflected from the enclosure to the desired output direction.

3. A light converting device according to claim 1 further comprising an occlusion support connected to the enclosure and the occlusion.

4. A light converting device according to claim 1 wherein the occlusion support has a first end connected to an interior surface of the enclosure and a second end opposite the first end connected to the occlusion.

5. A light converting device according to claim 1 wherein the conversion material is selected from the group consisting of phosphors, quantum dots, luminescent materials, and fluorescent materials.

6. A light converting device according to claim 1 wherein the source light is a monochromatic light.

7. A light converting device according to claim 1 wherein the source wavelength range is selected from the group consisting of a blue spectrum and an ultraviolet spectrum.

8. A light converting device according to claim 7 wherein the source wavelength range of the source light within the ultraviolet spectrum is between 200 nanometers and 400 nanometers.

9. A light converting device according to claim 7 wherein the source wavelength range of the source light within the blue spectrum is between 400 nanometers and 500 nanometers.

10. A light converting device according to claim 1 wherein the source light originates at least partially from within the enclosure.

11. A light converting device according to claim 1 wherein a reflecting surface of the occlusion is arcuate.

12. A light converting device comprising:

an enclosure;

an occlusion connected to the enclosure via an occlusion support; and a conversion material located adjacent to and generally conforming to a contour of at least part of the occlusion;

wherein at least part of the occlusion is located within the enclosure to receive a source light within a source wavelength range;

wherein the conversion material converts the source light to a converted light within a converted wavelength range;

wherein the occlusion reflects the converted light toward the enclosure and the enclosure reflects the converted light toward a desired output direction.

13. A light converting device according to claim 12 wherein the occlusion support has a first end connected to an interior surface of the enclosure and a second end opposite the first end connected to the occlusion.

14. A light converting device according to claim 12 wherein the conversion material is selected from the group consisting of phosphors, quantum dots, luminescent materials, and fluorescent materials.

15. A light converting device according to claim 12 wherein the source light is a monochromatic light.

16. A light converting device according to claim 12 wherein the source wavelength range is selected from the group consisting of a blue spectrum and an ultraviolet spectrum.

17. A light converting device according to claim 16 wherein the source wavelength range of the source light within the ultraviolet spectrum is between 200 nanometers and 400 nanometers.

18. A light converting device according to claim 16 wherein the source wavelength range of the source light within the blue spectrum is between 400 nanometers and 500 nanometers.

19. A light converting device according to claim 12 wherein the source light originates at least partially from within the enclosure.

20. A light converting device according to claim 12 wherein a reflecting surface of the occlusion is arcuate.

21. A method of converting a source light using a light converting device having an enclosure, an occlusion and a conversion material located adjacent to and generally conforming to a contour of the occlusion, the method comprising:

receiving the source light within a source wavelength range at the occlusion;

converting the source light into a converted light within a converted wavelength range; and reflecting the converted light from the occlusion toward a desired output direction.

22. A method according to claim 21 wherein at least a part of the occlusion is located within the enclosure.

23. A method according to claim 21 wherein reflecting the converted light towards the desired output direction further includes reflecting the converted light from the occlusion to the enclosure, and reflecting the converted light from the enclosure to the desired output direction.

24. A method according to claim 21 wherein the occlusion is connected to the enclosure using an occlusion support.

25. A method according to claim 24 wherein the occlusion support has a first end connected to an interior surface of the enclosure and a second end opposite the first end connected to the occlusion.

26. A method according to claim 21 wherein the source light is a monochromatic light.

27. A method according to claim 21 wherein the source wavelength range is selected from a group consisting of a blue spectrum and an ultraviolet spectrum.

28. A method according to claim 21 wherein the source wavelength range of the source light within the ultraviolet spectrum is between 200 nanometers and 400 nanometers.

29. A method according to claim 21 wherein the source wavelength range of the source light within the blue spectrum is between 400 nanometers and 500 nanometers.

30. A method according to claim 21 wherein the conversion material is selected from a group consisting of phosphors, quantum dots, luminescent materials, and fluorescent materials.

31. A method according to claim 21 wherein a reflecting surface of the occlusion is arcuate.

32. A method of using a light converting device comprising an occlusion located adjacent to an enclosure via an occlusion support and a conversion material located adjacent to and generally conforming to a contour of the occlusion, the method comprising:

receiving a source light within a source wavelength range at the occlusion;

converting the source light into a converted light within a converted wavelength range;

reflecting the converted light from the occlusion toward the enclosure; and reflecting the converted light from the enclosure to a desired output direction.

33. A method according to claim 32 wherein the occlusion support has a first end connected to an interior surface of the enclosure and a second end opposite the first end connected to the occlusion.

34. A method according to claim 32 wherein the source light is a monochromatic light.

35. A method according to claim 32 wherein the source wavelength range is selected from a group consisting of a blue spectrum and an ultraviolet spectrum.

36. A method according to claim 32 wherein the source wavelength range of the source light within the ultraviolet spectrum is between 200 nanometers and 400 nanometers.

37. A method according to claim 32 wherein the source wavelength range of the source light within the blue spectrum is between 400 nanometers and 500 nanometers.

38. A method according to claim 32 wherein the conversion material is selected from a group consisting of phosphors and quantum dots.

39. A method according to claim 32 wherein a reflecting surface of the occlusion is arcuate.

* * * * *